United States Patent [19]

Isaka

[11] 4,418,603

[45] Dec. 6, 1983

[54] DRIVE SHAFT SUPPORTING DEVICE FOR A MUSIC BOX WITH A PLATE FRAME

[75] Inventor: Akihiko Isaka, Okaya, Japan

[73] Assignee: Kabushiki Kaisha Sankyo Seiki Seisakusho, Shimosuwa, Japan

[21] Appl. No.: 344,690

[22] Filed: Feb. 1, 1982

[30] Foreign Application Priority Data

Feb. 17, 1981 [JP] Japan ..... 56-20112[U]

[51] Int. Cl.[3] ..... G10F 1/06

[52] U.S. Cl. ..... 84/95 R

[58] Field of Search ..... 84/94–101

[56] References Cited

U.S. PATENT DOCUMENTS

| | | | |
|---|---|---|---|
| 2,786,381 | 3/1957 | Gorr | 84/95 R |
| 2,880,639 | 4/1959 | Gorr | 84/95 R |
| 3,691,286 | 9/1972 | Komatsu et al. | 84/101 |
| 3,718,746 | 2/1973 | Kitamura et al. | 84/101 |

*Primary Examiner*—Lawrence R. Franklin

*Attorney, Agent, or Firm*—Sughrue, Mion, Zinn, Macpeak and Seas

[57] ABSTRACT

A device for supporting a music box drive shaft has an elastic U-shaped retaining plate which is adapted to engage a U-shaped steel plate frame which serves as a resonance plate. The retaining plate rather than the steel plate supports the drive shaft which lowers the manufacturing costs of the overall music box.

5 Claims, 2 Drawing Figures

DRIVE SHAFT SUPPORTING DEVICE FOR A MUSIC BOX WITH A PLATE FRAME

BACKGROUND OF THE INVENTION

1. Field of the Invention

The present invention relates to a drive shaft supporting structure which can be readily mounted on a thick steel plate frame of a music box.

2. Description of the Prior Art

In general, the frame of a music box is formed by die-casting zinc alloy. However, the cost of zinc alloy die-casting occupies a large part of the material and machining cost of the music box which makes it difficult to reduce the manufacturing cost thereof. In the case of a hand-operated music box where a drive shaft is hand-turned to turn a drum, the cost of the zinc alloy die-casting occupies about 20% of the manufacturing cost of the music box.

In order to overcome the above-described drawback, the frame may be made of a thick steel plate which is about 2.5 to 3.5 mm in thickness instead of the aforementioned die-cast zinc alloy. However, such a thick steel plate has not been employed to form the frame since it is difficult to finely machine a steel plate 2.5 to 3.5 mm in thickness. In particular, it is especially hard to form a drive shaft supporting means in a thick steel plate by machining the plate. Thus, no cost advantages are obtained if a thick steel plate is used.

SUMMARY OF THE INVENTION

Accordingly, an object of the present invention is to provide a drive shaft supporting structure for a music box with a steel plate frame in which the above-described difficulties have been eliminated.

A further object is to provide a music box having a thick steel plate and a separate drive shaft supporting structure which can be readily assembled.

The specific feature of the present invention resides in that engaging grooves are formed in both end portions of a first side plate which is set upright at one side of a thick steel plate frame. A U-shaped elastic retaining plate has engaging portions which are adapted to be engaged with the engaging grooves in the first side plate. In addition, the U-shaped elastic retaining plate has third and fourth side plates which have a bearing hole and a bearing groove formed therein which rotatably support a drive shaft. The engaging grooves in the first side plate are elastically engaged with the engaging portions on the elastic retaining plate by means of elastic pieces formed in a base plate of the elastic retaining plate.

DESCRIPTION OF THE PREFERRED EMBODIMENTS

Figure 1:
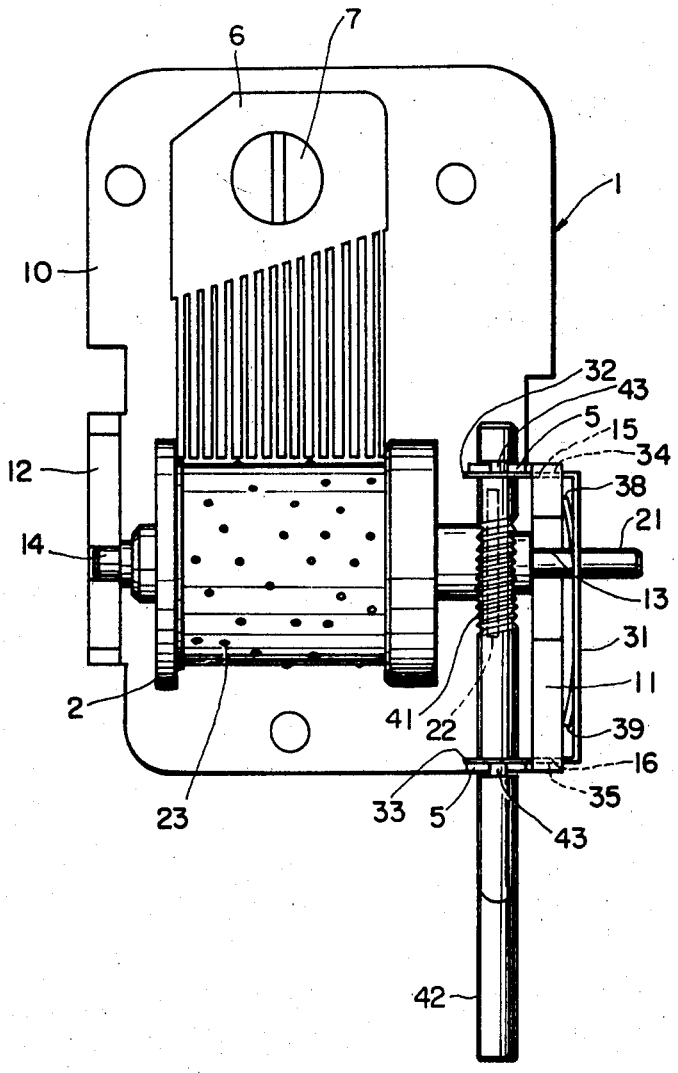
FIG. 1 is a plan view of a music box of the present invention.
Figure 2:
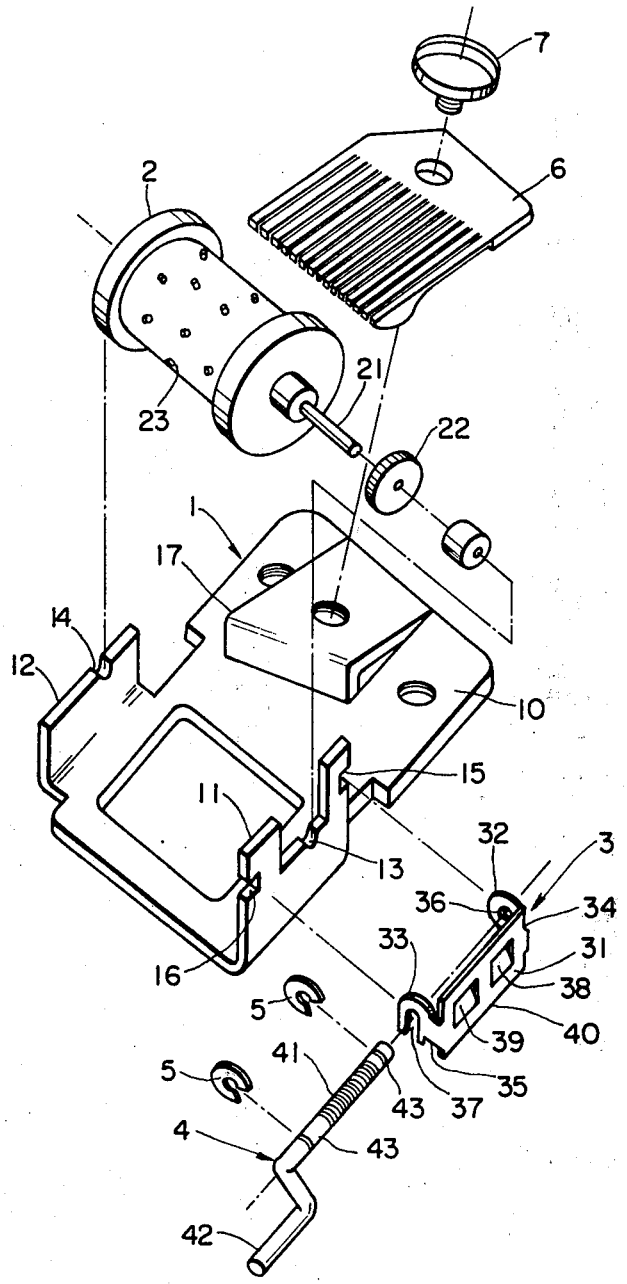
FIG. 2 is an exploded perspective view showing the essential components of the music box of FIG. 1.

A musical box as shown in FIGS. 1 and 2 has a thick steel plate frame 1 which includes a first base plate 10 and first and second side plates 11 and 12 which extend upwardly from opposite sides of the first base plate 10. A shaft 21 of a drum 2 is supported by U-shaped bearings 13 and 14 formed in the side plates 11 and 12 respectively. Engaging grooves 15 and 16 are formed in both end portions of the first side plate 11, and a U-shaped retaining plate 3 is fixedly engaged with the engaging grooves 15 and 16.

The retaining plate 3 includes a second base plate 31 and third and fourth side plates 32 and 33 which extend from both sides of the second base plate 31. The third and fourth side plates 32, 33 have engaging portions 34 and 35 therein which are adapted to be engaged with the aforementioned engaging grooves 15 and 16 located on both end portions of the first side plate 11. A bearing hole 36 is formed in the third side plate 32, and a U-shaped bearing groove 37 which opens downwardly is formed in the fourth side plate 33. Elastic pieces 38 and 39 protrude inwardly from the second base plate 31 toward the first side plate 11. A drive shaft 4 is inserted into the bearing hole 36 and the U-shaped bearing groove 37 and the movement of the drive shaft 4 in the thrust direction is limited by two E-type retaining rings 5.

A gear 22 is coupled directly or through a one-way clutch (not shown) to one end portion of a shaft 21 of a drum 2. The drive shaft 4 is threaded to form a worm 41 which engages the gear 22. One end portion of the drive shaft 4 is bent in the form of a crank and two circumferential grooves 43 are cut in the drive shaft, one being on each side of the worm 41.

A seat 17 is formed in the first base plate 10 of the steel plate frame 1 in such a manner that the seat 17 protrudes from the first base plate 10. A vibration plate 6 is fixedly secured to the seat 17 with a screw 7.

The music box is assembled as follows. The shaft 21 of the drum 2 is inserted into the bearings 13 and 14 of the first and second side plates 11 and 12. Then the retaining plate 3 is coupled to the first side plate 11, and the engaging portions 34 and 35 are engaged with the engaging grooves 15 and 16 against the force of the elastic pieces 38 and 39. After this engagement, the gear 22 side of the shaft 21 is positively held by an end portion 40 of the retaining plate 3. Next, the drive shaft 4 is inserted into the bearing hole 36 and the U-shaped bearing groove 37 in the third and fourth side plates 32, 33. The two retaining rings 5 are engaged with the circumferential grooves 43 on the drive shaft 4 and the worm 41 is engaged with the gear 22.

As the one end portion 42 of the drive shaft 4 is turned, the drum 2 turns causing the vibration reeds of the vibration plate 6 to be flipped or snapped by pins embedded in the outer wall of the drum thus playing music.

In the above-described embodiment, the retaining plate 3 is made of an elastic metal plate. However, it may be made of synthetic resin material as well. The second base plate 31 of the retaining plate 3 may be fixedly secured to the first side plate 11. The retaining ring 5 and the curcumferential groove 43 on one side of the drive shaft 4 may be eliminated if a stopper is formed on the drive shaft 4.

The steel plate frame 1 of a music box serves as the resonance plate. Therefore, the steel plate frame 1 must be made thick which makes machinging rather difficult. However, engaging the U-shaped elastic plate 3 to the steel plate frame 1 as described above eliminates troublesome machining ordinarily required in forming the steel plate frame so that the latter can be readily manufactured. In addition, the drive shaft supporting structure of a music box with a plate frame according to the present invention can be readily assembled since the drive shaft can be supported without a jig.

I claim:

1. A device for supporting a drive shaft in a music box having a drum supported by a second shaft, comprising:

a U-shaped steel plate frame having first and second side plates which extend upwardly from opposite ends of a first base plate, said first side plate having engaging grooves formed in both end portions thereof;

an elastic U-shaped retaining plate comprising a second base plate having elastic pieces and third and fourth side plates which extend from opposite ends of said second base plate, said third and fourth side plates having engaging portions therein for engaging said engaging grooves;

said engaging portions being engaged with said engaging grooves with said elastic pieces abutted against an outer wall of said first side plate;

said third side plate having a bearing hole for rotatably supporting a drive shaft, said fourth side plate having a U-shaped bearing groove which opens towards said drive shaft, said drive shaft being insertable into said U-shaped bearing groove;

bearing means formed in said first and second side plates for supporting said second shaft;

a gear mounted on said second shaft and being engageable with a worm in said drive shaft for driving said drum;

a vibration plate having vibration reeds; and means for mounting said vibration plate to said first base plate so that said vibration reeds on said vibration plate are snapped by pins on said drum.

2. The device claimed in claim 1, wherein said retaining plate is made of metal.

3. The device claimed in claim 1, wherein said retaining plate is made of a synthetic resin material.

4. The device claimed in claim 1, wherein said mounting means comprises a seat fixedly secured to said first base plate and a screw for securing said vibration plate to said seat.

5. The device claimed in claim 2, 3 or 4, wherein a thickness of said steel plate frame is between 2.5 and 3.5 mm.

* * * * *